US008079162B1

(12) United States Patent
Sherman

(10) Patent No.: US 8,079,162 B1
(45) Date of Patent: Dec. 20, 2011

(54) HEAVY EQUIPMENT RAKE ATTACHMENT

(76) Inventor: Donald C. Sherman, Darlington, MD (US)

( * ) Notice: Subject to any disclaimer, the term of this patent is extended or adjusted under 35 U.S.C. 154(b) by 0 days.

(21) Appl. No.: 12/143,082

(22) Filed: Jun. 20, 2008

(51) Int. Cl.
*E02F 3/96* (2006.01)

(52) U.S. Cl. ..... 37/405

(58) Field of Classification Search ..... 37/403–410, 37/468, 903, 444; 172/245, 247, 250, 252, 172/253, 817; 171/43, 63, 144
See application file for complete search history.

(56) References Cited

U.S. PATENT DOCUMENTS

| | | | | |
|---|---|---|---|---|
| D198,329 | S | 6/1964 | Ellis | |
| D216,143 | S | 11/1969 | Cline | |
| 4,125,952 | A * | 11/1978 | Jennings | 37/405 |
| 4,312,095 | A | 1/1982 | Mullins | |
| 4,790,717 | A * | 12/1988 | Anderson | 414/722 |
| 5,211,247 | A | 5/1993 | Johnsen | |
| 5,515,625 | A * | 5/1996 | Keigley | 37/405 |
| 5,664,348 | A * | 9/1997 | Omann | 37/405 |
| 6,308,505 | B1 | 10/2001 | Beckett | |
| 6,634,434 | B2 | 10/2003 | Ohzeki et al. | |
| 6,718,662 | B1 * | 4/2004 | Schaff | 37/405 |
| 6,996,926 | B2 * | 2/2006 | Fatemi | 37/468 |
| 7,040,079 | B2 | 5/2006 | Crosby | |

* cited by examiner

*Primary Examiner* — Robert Pezzuto
(74) *Attorney, Agent, or Firm* — Rosenberg, Klein & Lee

(57) ABSTRACT

The invention is a rake attachment for use with an excavator arm of heavy machinery. The preferred embodiment has two cross-members that make the invention easily installed with an automated excavator arm. An alternative embodiment provides for mounting hardware for use with a traditional excavator arm, which does not have a hydraulically operated attaching device. The invention is suited for use with the clearing of loose debris in and around a typical construction site. The construction debris may comprise loose wood scraps, tree branches, fencing, and other objects typical of a construction site.

15 Claims, 6 Drawing Sheets

HEAVY EQUIPMENT RAKE ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of heavy equipment, more specifically, a rake that attaches to the swing arm of heavy equipment.

B. Discussion of the Prior Art

As a preliminary note, it should be stated that there is an ample amount of prior art that deals with heavy equipment attachments. As will be discussed immediately below, no prior art discloses a rake attachment for heavy equipment that includes the configuration for easy installation.

The Crosby Patent (U.S. Pat. No. 7,040,079) teaches a rake that is attachable and pulled by a vehicle. However, the rake is rolled by a vehicle, as opposed to being attached to the end of an excavator arm in that it resembles a typical yard rake when used.

The Ohzeki et al. Patent (U.S. Pat. No. 6,634,434) teaches beach cleaner comprising a rake-like device that is pulled by a vehicle, and of which includes longitudinal members arranged in a hurdle shape for collecting waste and debris. Again, the rake-like device is pulled by a vehicle, as opposed to being attached to an excavator arm.

The Johnson Patent (U.S. Pat. No. 5,211,247) teaches a landscaping device having a raking portion and means to attach to a vehicle. Again, the rake-like device is pulled by a vehicle, as opposed to being attached to an excavator arm.

The Mullins Patent (U.S. Pat. No. 4,312,095) teaches a mobile lawn rake attachment for use in conjunction with conventional riding mowers. Again, the rake attachment is pulled by a vehicle, as opposed to being attached to an excavator arm.

The Beckett Patent (U.S. Pat. No. 6,308,505) teaches a leaf rake for mounting to the chassis of a conventional lawn tractor. Again, the rake-like device is pulled by a vehicle, as opposed to being attached to an excavator arm.

While the above-described devices fulfill their respective and particular objects and requirements, they do not describe a heavy equipment rake attachment that provides for the advantages of the heavy equipment rake attachment. In this regard, heavy equipment rake attachment departs from the conventional concepts and designs of the prior art.

SUMMARY OF THE INVENTION

The invention is a rake attachment for use with an excavator arm of heavy machinery. The preferred embodiment has two cross-members that make the invention easily installed with an automated excavator arm. An alternative embodiment provides for mounting hardware for use with a traditional excavator arm, which does not have a hydraulically operated attaching device. The invention is suited for use with the clearing of loose debris in and around a typical construction site. The construction debris may comprise loose wood scraps, tree branches, fencing, and other objects typical of a construction site.

An object of the invention is to provide a rake attachment for an excavator arm.

A further object of the invention is to provide a rake attachment that is easy to install upon an excavator arm.

A further object of the invention is to provide a rake attachment that is relatively simple in design.

A further object of the invention is to provide a rake attachment that is durable, effective, and affordable.

These together with additional objects, features and advantages of the heavy equipment rake attachment will be readily apparent to those of ordinary skill in the art upon reading the following detailed description of presently preferred, but nonetheless illustrative, embodiments of the heavy equipment rake attachment when taken in conjunction with the accompanying drawings.

In this respect, before explaining the current embodiments of the heavy equipment rake attachment in detail, it is to be understood that the heavy equipment rake attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the heavy equipment rake attachment. It is therefore important that the claims be regarded as including such equivalent construction insofar as they do not depart from the spirit and scope of the heavy equipment rake attachment. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
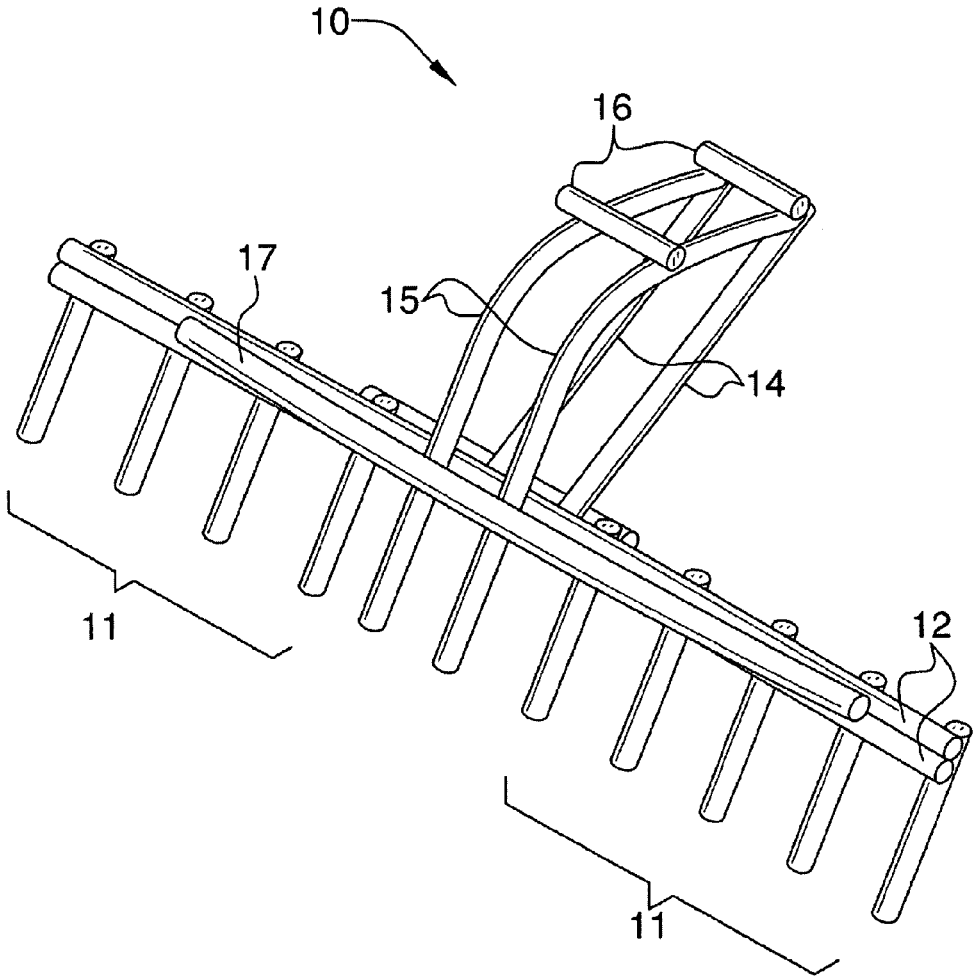
FIG. 1 illustrates an isometric front view of the self-installing embodiment of the invention.
Figure 2:
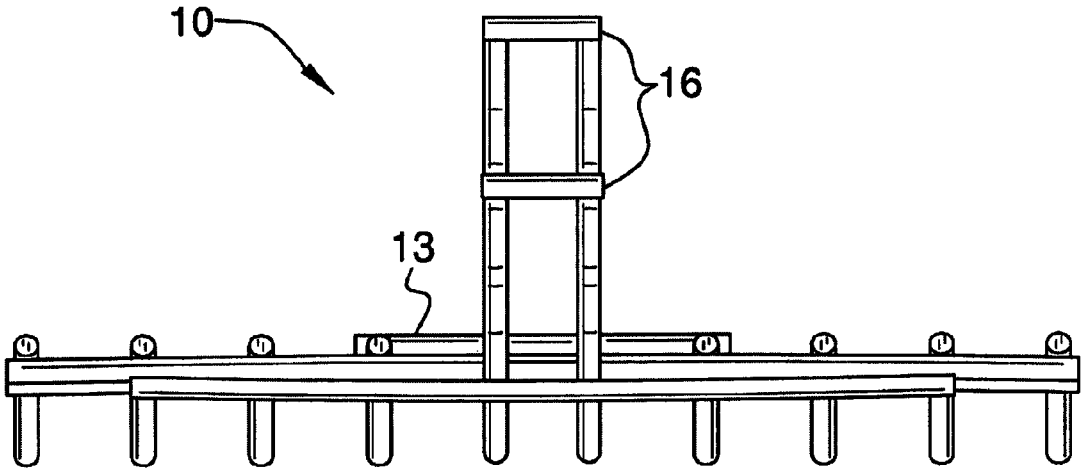
FIG. 2 illustrates a top view of the self-installing embodiment of the invention.
Figure 3:
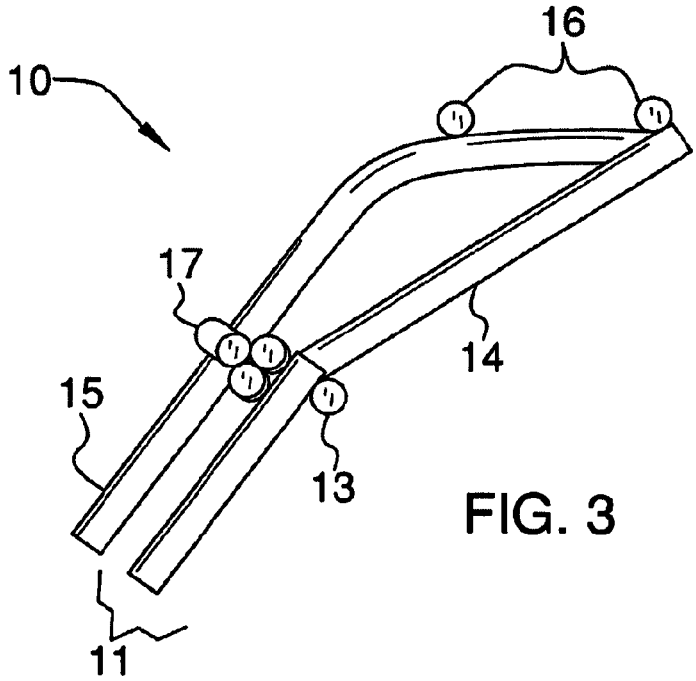
FIG. 3 illustrates a side view of the self-installing embodiment of the invention.
Figure 4:
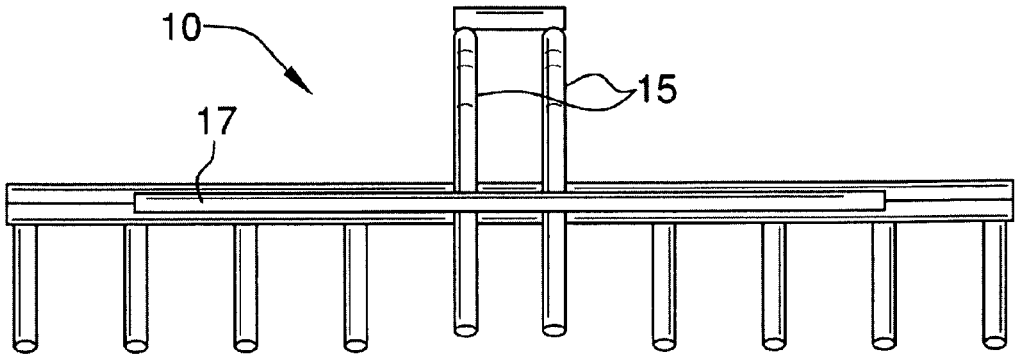
FIG. 4 illustrates a front view of the self-installing embodiment of the invention.
Figure 5:
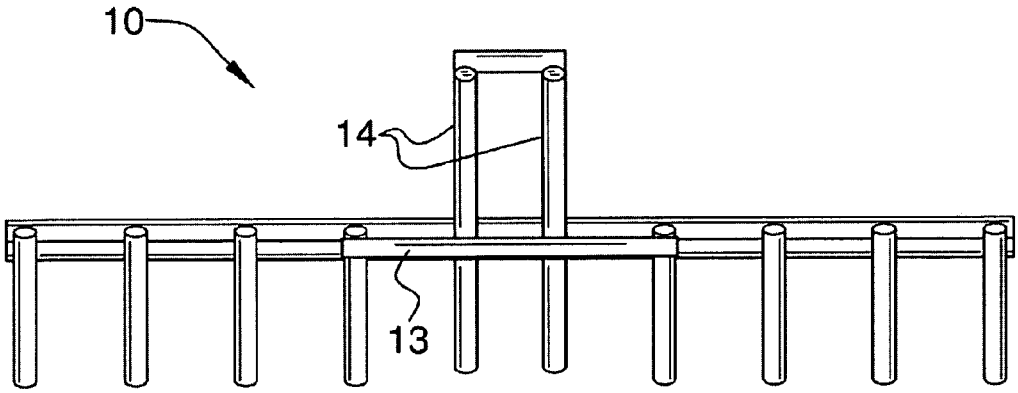
FIG. 5 illustrates a rear view of the self-installing embodiment of the invention.

Detailed reference will now be made to the self-installing embodiment of the invention, examples of which are illustrated in FIGS. 1-7. A heavy equipment rake attachment 10 (hereinafter invention) comprising a plurality of raking prongs 11, a raking prong stabilizer bar 12, a back brace 13, a rear support 14, a front support 15, mounting bars 16, and a front stabilizer bar 17. The above-mentioned components of the invention 10 are fastened together by a fastening means comprising welding, casting, or molding. The above-mentioned pieces of the invention 10 are made of a material comprising a metal, such as rebar.

Figure 6:
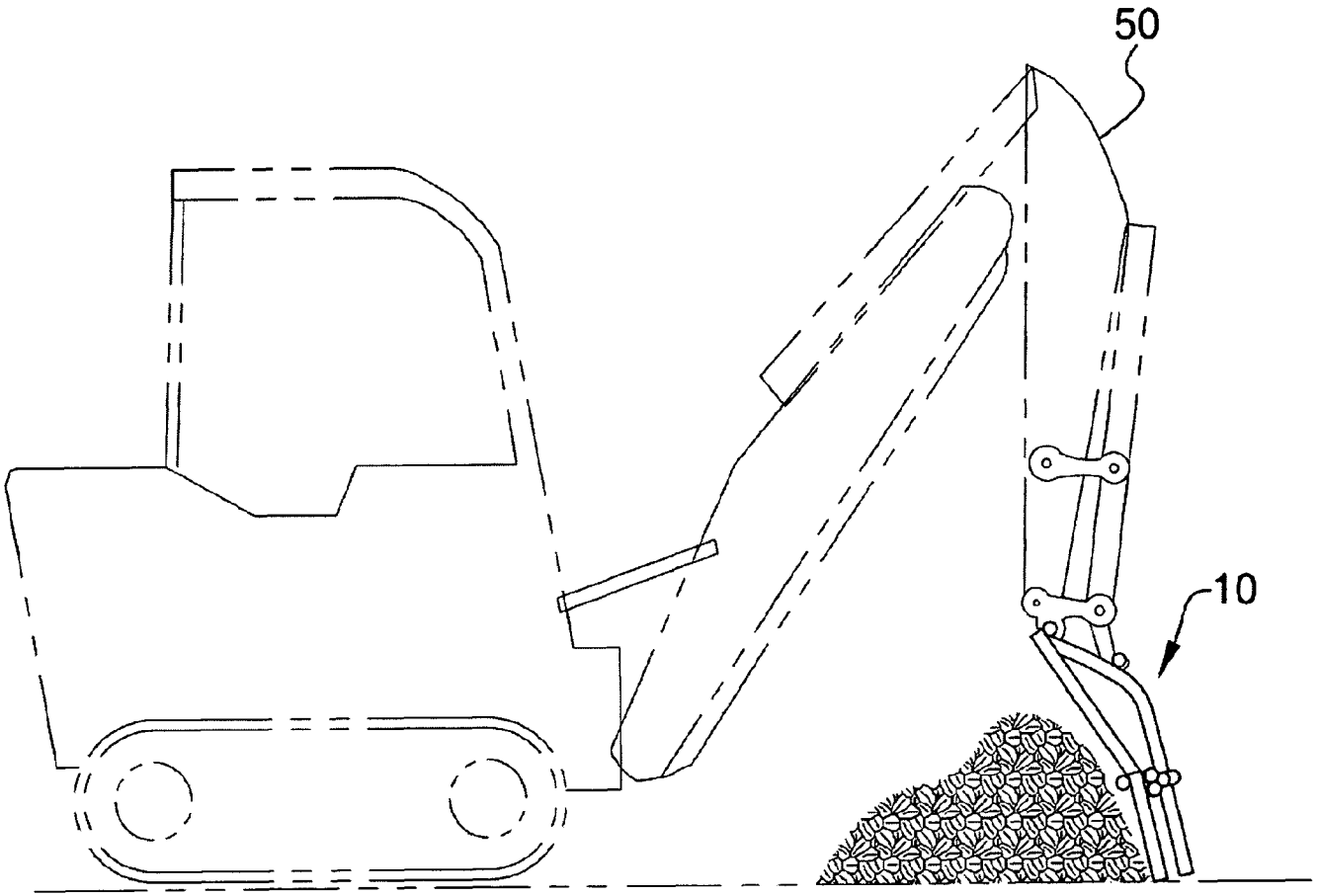
FIG. 6 illustrates the self-installing embodiment of the invention attached to an automated excavator arm of heavy equipment.
Figure 7:
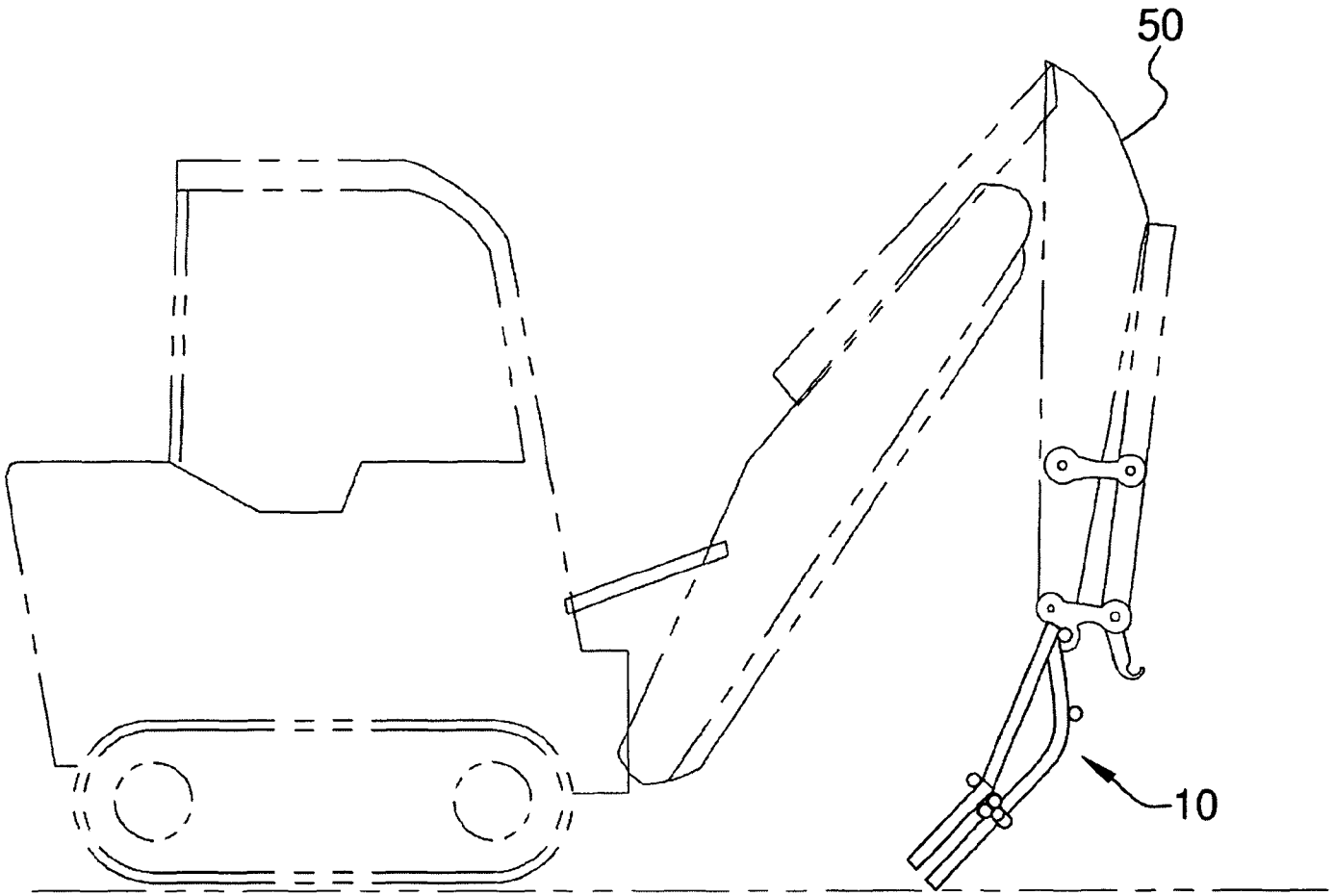
FIG. 7 illustrates the self-installing embodiment of the invention partially attached to an automated excavator arm of heavy equipment.

Referring to FIGS. 6 and 7, the invention 10 is installed upon an excavator arm 50, which is equipped with a hydraulically operated excavator attachment device.

Figure 8:
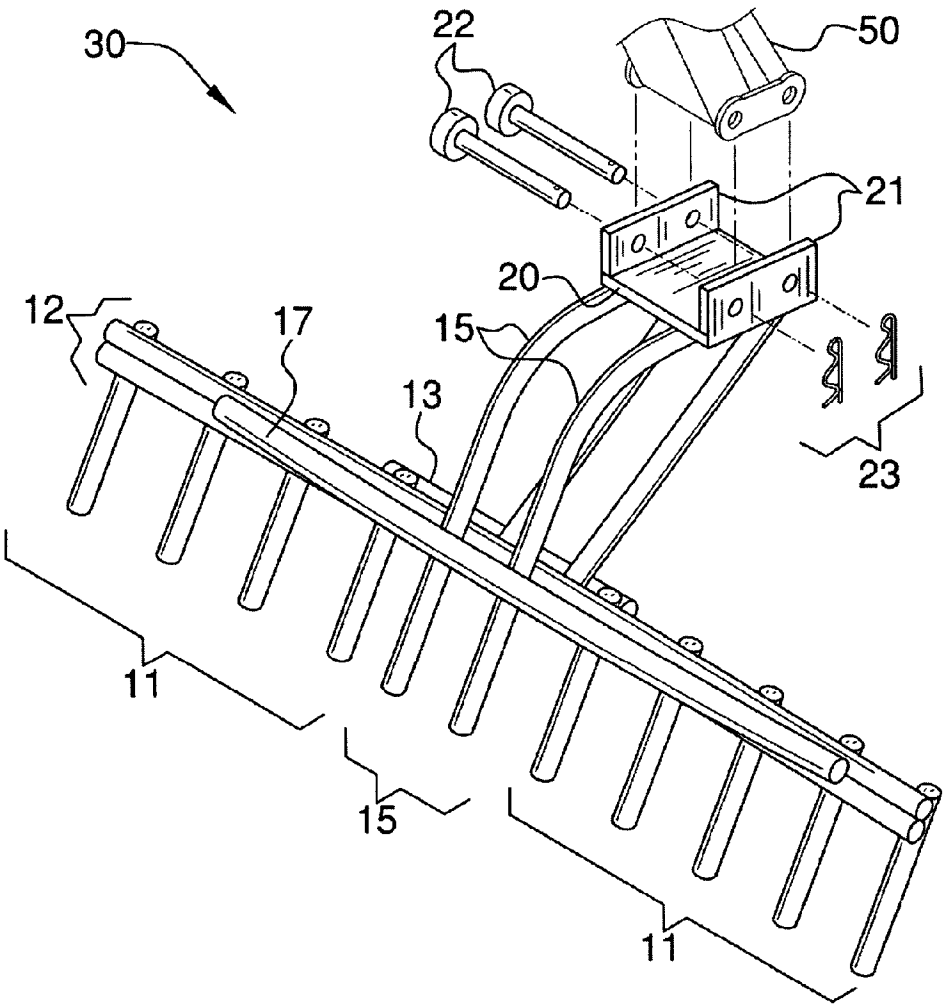
FIG. 8 illustrates an exploded view of the manually installed embodiment of the invention with a non-automated excavator arm of heavy equipment.

Referring now to FIG. 8, detailed reference will now be made to the manually installed embodiment 30 (hereinafter second embodiment), which includes a plurality of raking prongs 11, a raking prong stabilizer bar 12, a back brace 13, a rear support 14, a front support 15, mounting bars 16, a front stabilizer bar 17, a mounting plate 20, a plurality of mounting brackets 21, a pair of pins 22, and a pair of pin clips 23. The above-mentioned components of the second embodiment 30 are fastened together by a fastening means comprising welding, casting, or molding. The above-mentioned pieces of the second embodiment 30 are made of a material comprising a metal.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

Variations and alternatives of the present embodiment including equivalent structures and structural equivalents are readily apparent to those of ordinary skill in the art upon reading the present disclosure, and such variations and alternatives are incorporated in the invention unless otherwise expressly indicated in the claims.

The inventor claims:

1. A heavy equipment rake attachment for an excavator arm comprising:

(a) a rake including a plurality of raking prongs extending therefrom;

(b) a pair of longitudinally displaced mounting bars defining a mounting plane;

wherein the mounting bars are attached to the rake by a support structure, said rake being substantially centrally braced to extend laterally outward from said mounting bars, said rake being thereby maintained in braced manner relative to the excavator arm to brace against transverse recoil and direct said raking prongs transversely downward relative to the mounting plane for substantially upright raking engagement along a work surface;

wherein the mounting bars enable the rake to be attached to an automated attaching means of an excavator arm of a heavy equipment; the automated attaching means including a hydraulically operated excavator attachment device having control arms actuable to releasably engage the mounting bars.

2. The heavy equipment rake attachment as described in claim 1 wherein the attaching means comprises welding, casting, or molding.

3. The heavy equipment rake attachment as described in claim 2 wherein the rake and the pair of mounting bars are made of a material comprising a metal.

4. A heavy equipment rake attachment for an excavator arm comprising:

(a) a rake including a plurality of raking prongs extending therefrom;

(b) a mounting plate defining a mounting plane and a pair of longitudinally displaced mounting members coupled thereto;

wherein the mounting plate is fastened to the rake by a support structure, said rake being substantially centrally braced to extend laterally outward from said mounting members, said rake being thereby maintained in braced manner relative to the excavator arm to brace against transverse recoil and direct said raking prongs transversely downward relative to the mounting plane for substantially upright raking engagement along a work surface; and, (c) a pair of mounting brackets formed to extend from the mounting plate for releasable attachment to an end of an excavator arm via an attaching means.

5. The heavy equipment rake attachment as described in claim 4 wherein the attaching means comprises a plurality of pins and pin clips coupling the end of the excavator arm to the mounting brackets in releasably locked manner.

6. The heavy equipment rake attachment as described in claim 5 wherein the rake, the mounting plate, and the mounting brackets are made of a material comprising a metal.

7. A heavy equipment rake attachment for modular coupling to an excavator arm for ground working manipulation thereby, comprising:

a mounting portion extended along a mounting plane, said mounting portion including a pair of longitudinally displaced mounting members;

a rake including a plurality of raking prongs extending therefrom, said raking prongs being disposed in spaced manner along at least one raking plane; and, a support structure offsetting said rake from said mounting portion, said support structure including a plurality of support members projecting forward and downward to said rake from said mounting portion, said rake being substantially centrally braced to extend laterally outward from said mounting members, said rake being thereby maintained in braced manner relative to the excavator arm to brace against transverse recoil and direct said raking prongs transversely downward relative to the mounting plane for substantially upright raking plane engagement along a ground surface.

8. The heavy equipment rake attachment as recited in claim 7, wherein said rake includes a laterally extended stabilizer bar, said raking prongs being spaced laterally along said stabilizer bar to project transversely downward therefrom.

9. The heavy equipment rake attachment as recited in claim 7, wherein said raking prongs are varied in relative spacing along said raking plane.

10. The heavy equipment rake attachment as recited in claim 7, wherein a front pair of said support members terminate respectively at a pair of spaced prongs defining a second raking plane offset from said raking plane defined by said raking prongs.

11. The heavy equipment rake attachment as recited in claim 7, wherein said mounting members are spaced one from the other along said mounting plane.

12. The heavy equipment rake attachment as recited in claim 7, wherein said mounting portion includes:

a mounting plate extending along said mounting plane and a pair of mounting brackets formed thereon for receiving a coupling end of the excavator arm therebetween; and, a plurality of pins releasably coupled to said mounting brackets for locking the coupling end of the excavator arm thereto.

13. The heavy equipment rake attachment as recited in claim 12, wherein said mounting portion further includes a plurality of releasable pin clips retaining said pins on said mounting brackets.

14. The heavy equipment rake attachment as recited in claim 7, wherein said support structure is joined to each of said mounting portion and said rake by a welding, casting, or molding.

15. The heavy equipment rake attachment as recited in claim 7, wherein said rake and said mounting portion are each made of a metallic material.

* * * * *